US008123555B2

(12) United States Patent
Chen

(10) Patent No.: US 8,123,555 B2
(45) Date of Patent: Feb. 28, 2012

(54) COAXIAL ELECTRICAL CONNECTOR WITH ANTI-WICK SYSTEM

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/842,053

(22) Filed: Jul. 23, 2010

(65) Prior Publication Data

US 2011/0021071 A1 Jan. 27, 2011

(30) Foreign Application Priority Data

Jul. 24, 2009 (CN) ..... 200920306867

(51) Int. Cl.
*H01R 9/05* (2006.01)

(52) U.S. Cl. ..... 439/578

(58) Field of Classification Search ..... 439/578, 439/579, 63
See application file for complete search history.

(56) References Cited

U.S. PATENT DOCUMENTS 5,595,499 A * 1/1997 Zander et al. ..... 439/352
6,099,322 A * 8/2000 Beloritsky et al. ..... 439/63
6,394,814 B2 * 5/2002 Schmid et al. ..... 439/550
6,474,995 B1 * 11/2002 Wu ..... 439/63
7,008,235 B2 * 3/2006 Watanabe ..... 439/63
7,118,383 B2 * 10/2006 Nagata et al. ..... 439/63
7,217,137 B1 * 5/2007 Nakagawa ..... 439/63
7,217,156 B2 * 5/2007 Wang ..... 439/579
7,334,327 B1 * 2/2008 Chen et al. ..... 29/876
7,445,458 B1 * 11/2008 Yamane ..... 439/63
7,651,334 B2 * 1/2010 Zhang ..... 439/63
7,651,335 B2 * 1/2010 Chen ..... 439/63
2008/0268705 A1 * 10/2008 Yamane ..... 439/578
2009/0149063 A1 * 6/2009 Yotsutani ..... 439/578
2009/0318019 A1 * 12/2009 Ellis et al. ..... 439/578
2010/0081320 A1 * 4/2010 Maruyama et al. ..... 439/578
2010/0093210 A1 * 4/2010 Zeng ..... 439/578
2010/0190376 A1 * 7/2010 Chen et al. ..... 439/578
2010/0297876 A1 * 11/2010 Chen ..... 439/578
2011/0021071 A1 * 1/2011 Chen ..... 439/578
2011/0053411 A1 * 3/2011 Zuinen et al. ..... 439/578

* cited by examiner

*Primary Examiner* — Tulsidas C Patel
*Assistant Examiner* — Vladimir Imas
(74) *Attorney, Agent, or Firm* — Wei Te Chung; Andrew C. Cheng; Ming Chieh Chang

(57) ABSTRACT

A coaxial electrical connector includes a metallic shell having a tubular section with an axial direction and a soldering leg, a central contacts having a contacting section extending in the axial direction within the tubular section and a dielectric seat molded so as to hold together said metallic shell and the central contact as a unit. The metallic shell defines a filled groove around an inner face thereof and perpendicular to the axial direction. The filled groove is to receive a projection of the dielectric seat during a cool process of a molded process to form the coaxial electrical connector.

13 Claims, 3 Drawing Sheets

COAXIAL ELECTRICAL CONNECTOR WITH ANTI-WICK SYSTEM

BACKGROUND OF THE INVENTION

1. Field of the Invention

The present invention relates to the art of electrical connectors, and more particularly to a coaxial electrical connector for being connected to a printed circuit board.

2. Description of the Related Art

A conventional coaxial connector includes an insulating seat, and a central conductive terminal and a metallic shell both hold in the seat by Injection Molding process. The metallic shell includes a tube portion in which the terminal is located to form a mating end and a soldering leg bending from a bottom edge of the tube portion. When welded the soldering leg on a printed circuit board where the connector is mounted, melted solders wick will happed upwards along insides of the shell, especially into the mating end, resulting in incorrect mating of a counter connector to the connector.

Therefore, there is a need to provide a coaxial electrical connector to resolve the above-mentioned problem.

SUMMARY OF THE INVENTION

Therefore, an object of the present invention is to provide a coaxial electrical connector with an anti-wick system.

To fulfill the above-mentioned object, a coaxial electrical connector comprises a metallic shell having a tubular section with an axial direction and a soldering leg, a central contacts having a contacting section extending in the axial direction within the tubular section and a dielectric seat molded so as to hold together said metallic shell and the central contact as a unit. The metallic shell defines a filled groove around an inner face thereof and perpendicular to the axial direction. The filled groove is to receive a projection of the dielectric seat during a cool process of a molded process to form the coaxial electrical connector.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
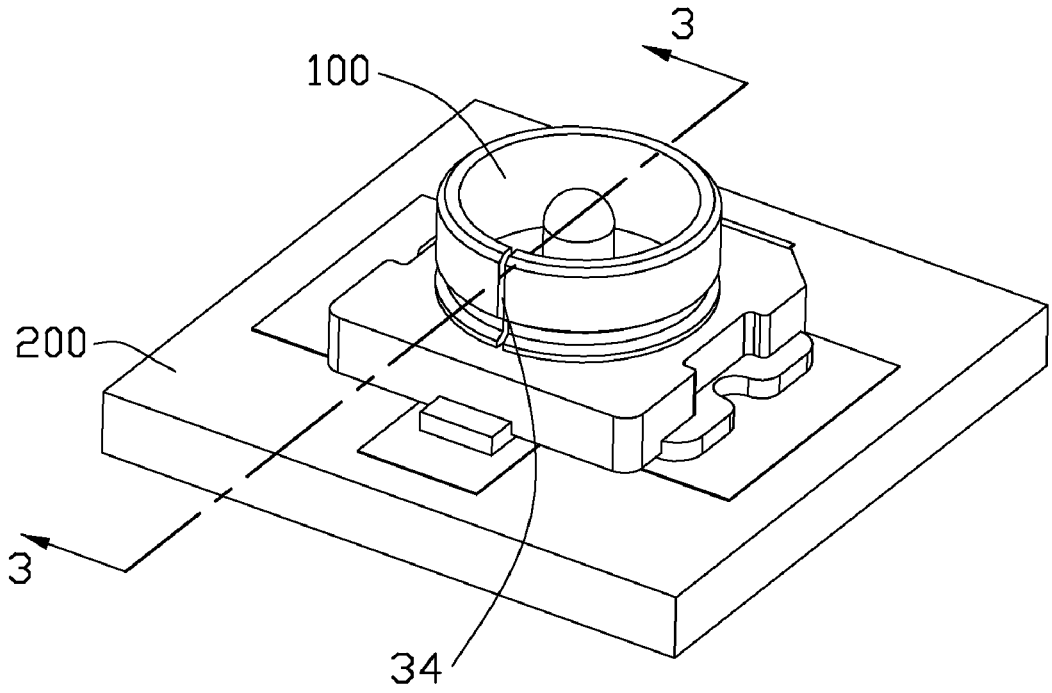
FIG. 1 is an assembled, perspective view of an electrical connector assembly including thereof a coaxial electrical connector and a printed circuit board according to an embodiment of the present invention.
Figure 2:
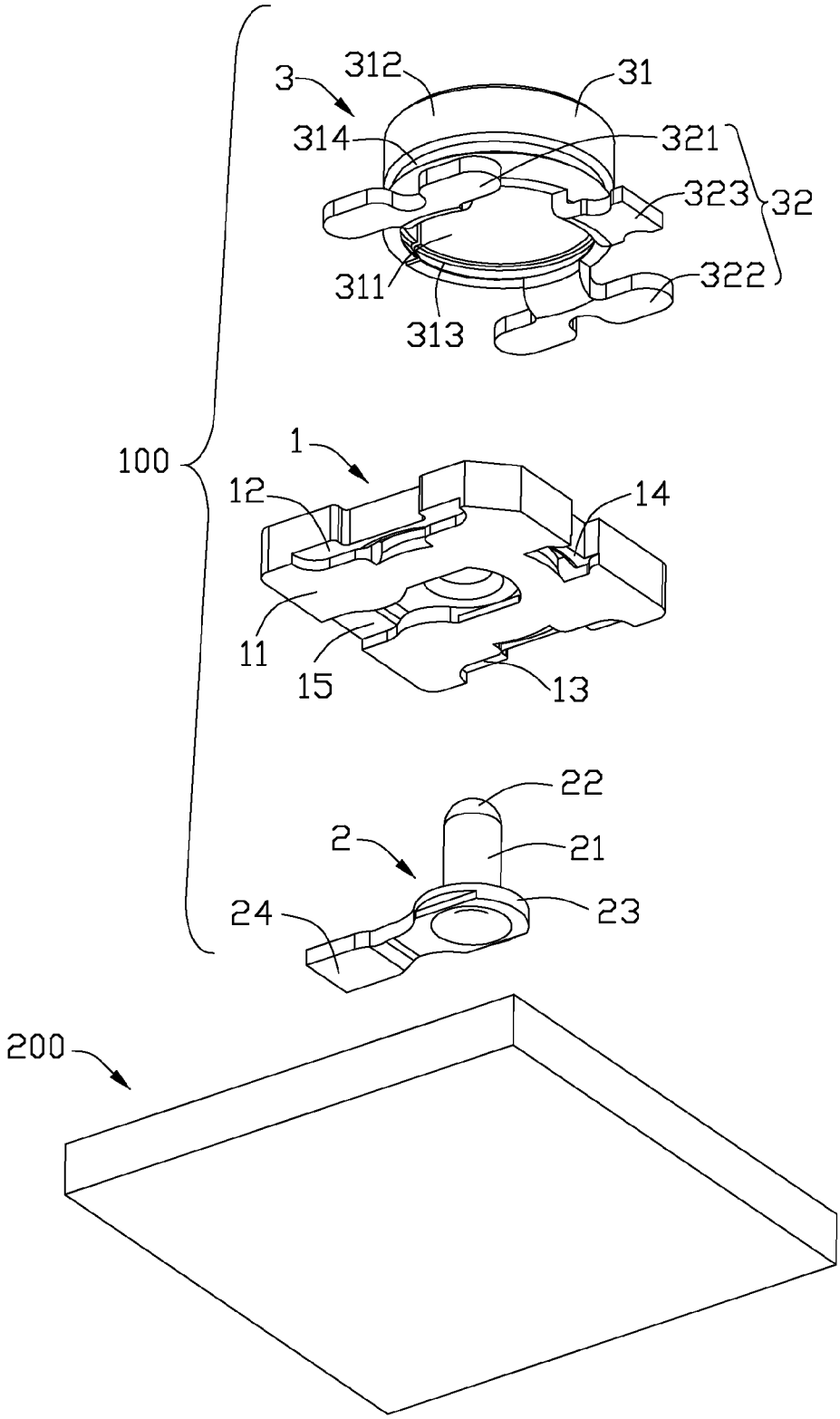
FIG. 2 is an exploded perspective view of the electrical connector assembly of FIG. 1.
Figure 3:
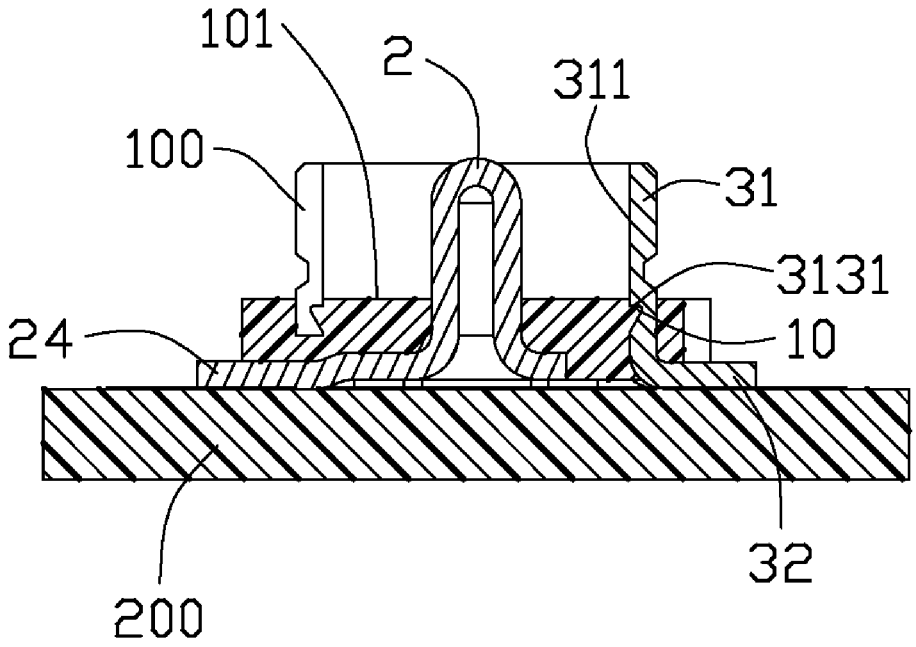
FIG. 3 is a cross-sectional view of the electrical connector assembly of FIG. 1 taken along line 3-3 thereof.

Referring to FIGS. 1 to 3, a coaxial connector 100 according to an embodiment of the present invention is shown be mounted on and electrically connected to a printed circuit board 200. The coaxial connector 100 includes a metallic shell 3, a central contact 2 and a dielectric seat 1 that integrally holds the metallic shell 3 and the central contact 2 as a unit.

The metallic shell 3 is made by bending and forming a metal sheet so as to provide a tubular section 31 having an axial line in a plugging direction with a counter connector (not shown) and three leg sections 32 extending outwardly from a bottom 11 of the insulating seat 1. The tubular section 31 is provided with slot 34 along the axial line and an engaging groove 314 around the outer face 312 thereof which is perpendicular to the axial line, for engagement with an outer conductor of a mating connector (not shown) for preventing separation. The tuber section is further provided with a filled groove 313 around an inner face 311 thereof which is perpendicular to the axial line. The filled groove 313 is configured with a ring shape so as to be filled with insulating materials during the inserted molder process of the connector, resulting in a better engagement of the seat 1 and the metallic shell 3. After cooling of said process, a projection 10 is formed to in the filled groove 313. Furthermore, the filled groove 313 has a horizontal face 3131 and which will block the melted solders from wicking upwards. The engaging groove 314 is disposed above a top face 101 of the insulating seat 1.

The soldering legs 32 included a pair of first legs 321, 322 symmetrical at two opposite sides of the slot 34 and a second leg 322 between the pair of first legs and at opposite to the slot 34. The first legs 321, 322 are wider than the second leg 323.

The central contact 2 is made by bending and forming a metal sheet so as to provide a contacting section 21 that extends in the axial line within the tubular section 31, and a radial section 23 that extends outwardly in a radial direction from a bottom of the contacting section 21. The contact section 21 is made by deep-drawing pressing a metal sheet so as to provide a hollow form having a semi-spherical tip 22 and flared bottom that leads to the radial section 23. An extension soldering section 24 extends in the radial direction from the radial section 23, which is adapted to be in contact with the printed circuit board 200.

The insulating seat 1 has recesses 12, 13, 14 to dispose the soldering legs of the metallic shell 1 on the bottom face 11 thereof. The bottom face further is provided with a recess 15 to dispose the soldering section 24, which communicates with the middle hole to receive the radial section 23.

While the present invention has been described with reference to preferred embodiments, the description of the invention is illustrative and is not to be construed as limiting the invention. Various modifications to the present invention can be made to preferred embodiments by those skilled in the art without departing from the true spirit and scope of the invention as defined by the appended claims.

What is claimed is:

1. A coaxial electrical connector comprising:

a metallic shell having a tubular section with an axial direction and a soldering leg;

a central contacts having a contacting section extending in the axial direction within the tubular section;

a dielectric seat molded so as to hold together said metallic shell and the central contact as a unit; and the metallic shell defining a filled groove around an inner face thereof and perpendicular to the axial direction, the filled groove is to receive a projection of the dielectric seat during a cooling process of a molded process to form the coaxial electrical connector;

wherein the metallic shell is provided with an engaging groove around an outer face thereof and perpendicular to the axial line;

wherein the engaging groove is located above a top face of the dielectric seat while the filled groove is below the top face of the dielectric seat.

2. The coaxial electrical connector as claimed in claim 1, wherein leg sections extend outwardly from a bottom of the tubular section.

3. The coaxial electrical connector as claimed in claim 2, wherein the central contact has a radial section at a bottom end of the contacting section and a soldering section extending outward of the radial section.

4. The coaxial electrical connector as claimed in claim 1, wherein the filled groove has a horizontal face facing downwards.

5. A coaxial electrical connector comprising:

a dielectric seat has a top face and a bottom face opposite to the top face;

a metallic shell having a tubular section, the tubular section embedded in the dielectric seat with a lower portion thereof and projecting above the top face of the dielectric seat with an upper portion thereof; and a central contact having a contacting section within the tubular section;

wherein the lower portion of the metallic shell defines a filled groove around an inner face thereof, the filled groove is located under the top surface of the dielectric seat;

wherein the upper portion of the metallic shell defines an engaging groove around an outer face thereof, the engaging groove is located above the top face of the dielectric seat.

6. The coaxial electrical connector as claimed in claim 5, wherein the filled groove is filled with a projection of the dielectric seat.

7. The coaxial electrical connector as claimed in claim 6, wherein the filled groove has a horizontal face facing to the bottom face and a slant face extending from a distal end of the horizontal face, the horizontal face and the slant face form a sharp angle.

8. The coaxial electrical connector as claimed in claim 6, wherein the metallic shell and the central contact have at least one soldering leg respectively extending out of the bottom face of the dielectric seat, the filled groove are aligned with the at least one soldering leg of the metallic shell in a vertical direction.

9. An electrical connector comprising:

a block type insulative housing defining a center through hole between opposite top and bottom surfaces thereof;

an inner metallic contact having a center contact section received in the through hole and extending upwardly above said top surface, and a tail section extending from a bottom portion of the center contact in a first direction; and an outer metallic contact defining a tubular shell insert-molded within the housing and surrounding the center contact, a plurality of solder tails unitarily extending outwardly radially from a bottom edge of the tubular shell; wherein a recess structure is formed in an inner surface of the tubular shell under the top surface of the housing and essentially aligned with the corresponding solder tail in a vertical direction perpendicular to said first direction so as to hinder solder-wicking from said solder tail.

10. The electrical connector as claimed in claim 9, wherein said recess is essentially filled with said housing.

11. The electrical connector as claimed in claim 9, wherein said corresponding solder tail extends in a second direction opposite to the first direction.

12. The electrical connector as claimed in claim 11, wherein said corresponding solder tail is opposite to the tail section diametrically.

13. The electrical connector as claimed in claim 9, wherein said recess further extends circumferentially along said shell in a curved manner.

* * * * *